United States Patent [19]

Rouse

[11] 4,218,004

[45] Aug. 19, 1980

[54] INCREMENTAL STRIP FEEDER

[75] Inventor: John W. Rouse, Fair Lawn, N.J.

[73] Assignee: American Can Company, Greenwich, Conn.

[21] Appl. No.: 972,070

[22] Filed: Dec. 21, 1978

[51] Int. Cl.[2] ..... B65H 17/44

[52] U.S. Cl. ..... 226/149; 226/158

[58] Field of Search ..... 226/149, 145, 146, 147, 226/151, 158, 162, 115, 120; 72/421, 422

[56] References Cited

U.S. PATENT DOCUMENTS

| | | | |
|---|---|---|---|
| 2,128,964 | 9/1938 | Pityo | 226/149 |
| 3,556,376 | 1/1971 | Offterdinger | 226/151 |
| 3,863,823 | 2/1975 | Alfred | 226/158 |
| 4,106,324 | 8/1978 | Gotz | 226/149 |

*Primary Examiner*—Edward J. McCarthy

*Attorney, Agent, or Firm*—Robert P. Auber; Stuart S. Bowie; Aaron Passman

[57] ABSTRACT

Apparatus for incremental feeding of soft metal, foil, paper or plastic strip into a machine. The apparatus employs a pair of gripping means which cooperate to advance the strip incrementally without marring or otherwise defacing the soft surface. The first gripping means reciprocates back and forth to advance the strip. The second gripping means is stationary and retains the advanced strip to prevent its retreat when the first gripping means returns for the next stroke.

3 Claims, 5 Drawing Figures

INCREMENTAL STRIP FEEDER

BACKGROUND OF THE INVENTION

High volume manufacturing equipment such as a conversion press described in U.S. Pat. No. 4,026,276, for converting basic can ends into easy open ends requires considerable auxiliary apparatus, tooling and gaging devices to facilitate the speed and automation required for high product quality and minimal scrap generation. As a result, the introduction and design of auxiliary apparatus is often constrained by the availability of space for the placement of the apparatus.

One of the problems associated with such press operations is the need to feed soft metal or plastic to the press for use in the construction of opening tabs particularly when such tabs are of a composite nature. The high production rates require that the strip stock be rapidly fed, but at the same time the advancement must be in discrete increments rather than in a continuous manner.

Incremental strip feeders are known which employ pinch rolls with the drive roll disposed beneath an overhead floating roll and wherein the strip is threaded between the rolls for incremental advancement. These strip feeders tend to compress and deform soft stock. Incremental strip feeders are also known in which a depending finger is reciprocated to push the strip in incremental advancement. At the end of the forward stroke, the finger is mechanically raised thereby releasing the strip and allowing the finger to be returned for the next advancement. This structure lacks the requisite precision for the manufacture of composite open tabs.

Accordingly it is an objective of this invention to provide a reliable strip feed which can incrementally advance a soft strip or foil without defacing or otherwise damaging the surface thereof.

It is further an objective of this invention to provide a strip feed unit which can precisely advance the strip by minimizing the slack or lost motion of the strip in each incremental advance.

Finally, it is an objective of this invention to provide a compact strip feed unit which is economical to manufacture and service and which may be readily incorporated onto apparatus when the availability of space is limited.

The inventor is not aware of any art which is material to the examination of the application.

SUMMARY OF THE INVENTION

It may be seen that the aforementioned objects of this invention may be attained in an apparatus for incrementally advancing strip material which includes a feeding surface, a first gripping means positioned to bear against the feeding surface, a second gripping means aligned with the first gripping means and positioned to bear against the feeding surface and a means for reciprocating the second gripping means toward and away from the first gripping means. In advancement the second gripping means seizes the material, advances the material and releases the material. The first gripping means accepts the material as it is advanced and retains the material, preventing its retreat when the second gripping means returns for the next increment.

It is preferable, that the apparatus for incrementally advancing strip metal include a base with a first feeding surface mounted thereon and a second feeding surface in alignment with and coplanar to the first feeding surface. Further, that apparatus include a means for reciprocating in unison, the second feeding surface and the second gripping means. In this way the strip is seized between the second gripping means and second feeding surface and carried forward. Upon return of the second gripping means and surface, the metal strip is retained by the gripping action between the first gripping means and the first gripping surface.

It is also desirable that the first and second gripping means each include a plurality of gripper elements received in a slotted gripper housing, with the gripper elements arrayed in parallel and transversely disposed to the longitudinal axis of the feeding surfaces. Further, that the gripper elements be urged to bear against the feeding surface by a gripper biasing means. In this way the second gripping means and second feeding surface cooperate to seize the metal strip therebetween and advance the strip toward the first gripping means which in turn seizes the advanced strip with the cooperation of the first feeding surface thereby preventing its retreat as the second gripping means and the second feeding surface retire for the next reciprocation.

It is also advantageous for the input end of the first feeding surface and the discharge end of the second feeding surface to be provided with intermeshing teeth which cooperate to ensure a continuity of feeding surface even in reciprocation.

Finally it is advantageous to include stop means for the first and second gripping means which serve to limit the sliding movement of the gripper elements in the slots of their respective housings. The stops which are biased to bear against the gripper housing are provided with handle means which permit the stops to be pivoted against the biasing means and thereby to raise the gripper elements off of the metal strip for the release thereof.

DETAILED DESCRIPTION OF THE ILLUSTRATED EMBODIMENT

Figure 1:
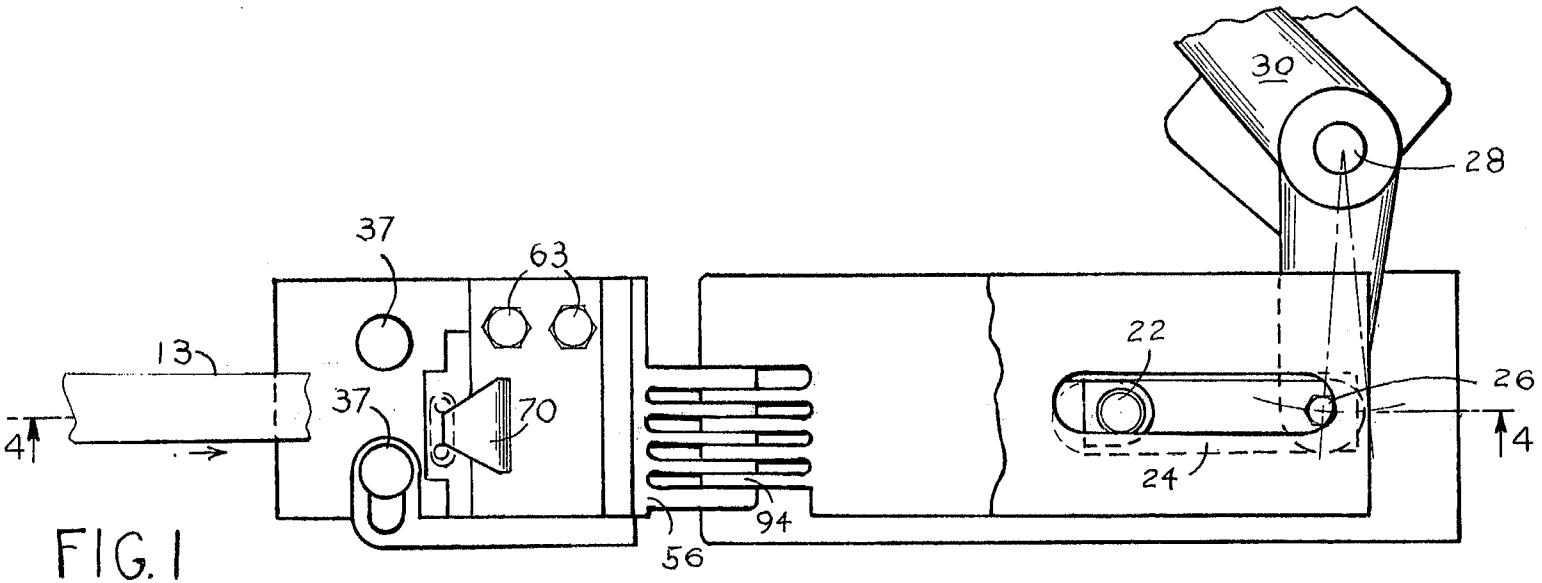
FIG. 1 is a plan view of the strip feeder with the gripper housing and retainer removed from the stationary guide plate to show interengagement of the guide plate teeth.
Figure 2:
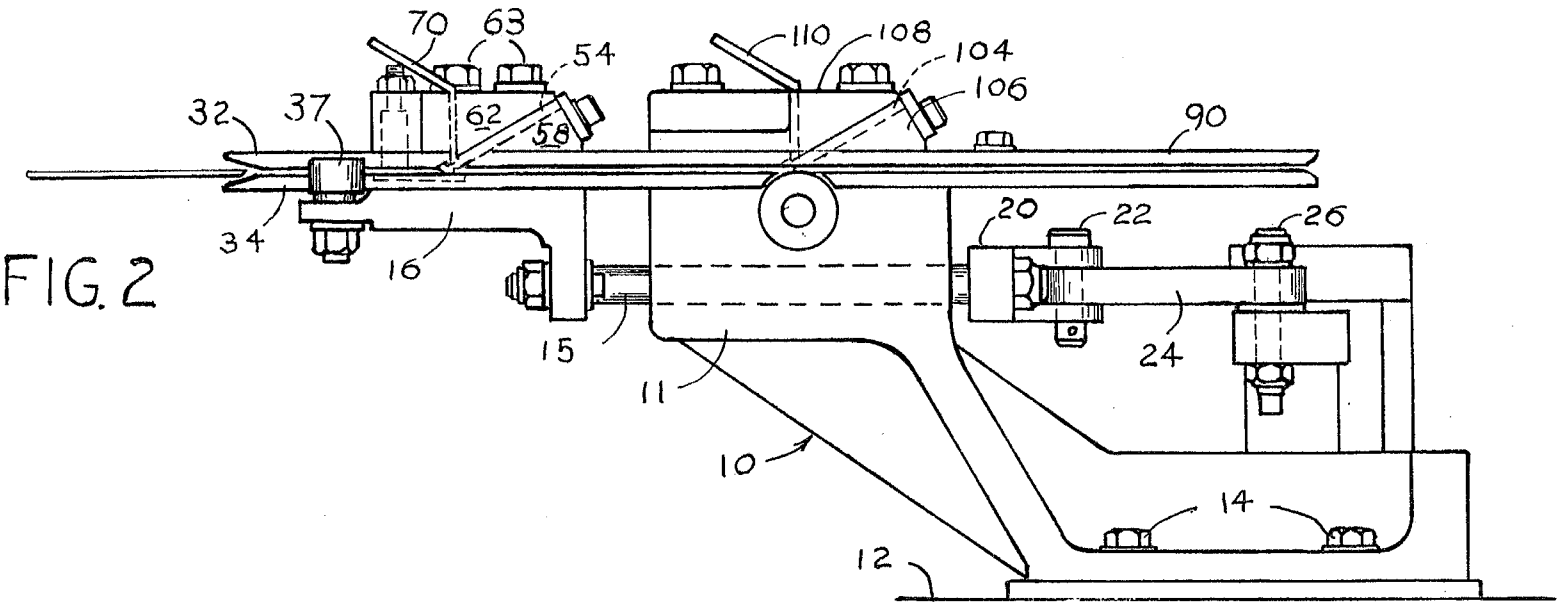
FIG. 2 is a side elevation of the strip feeder.
Figure 3:
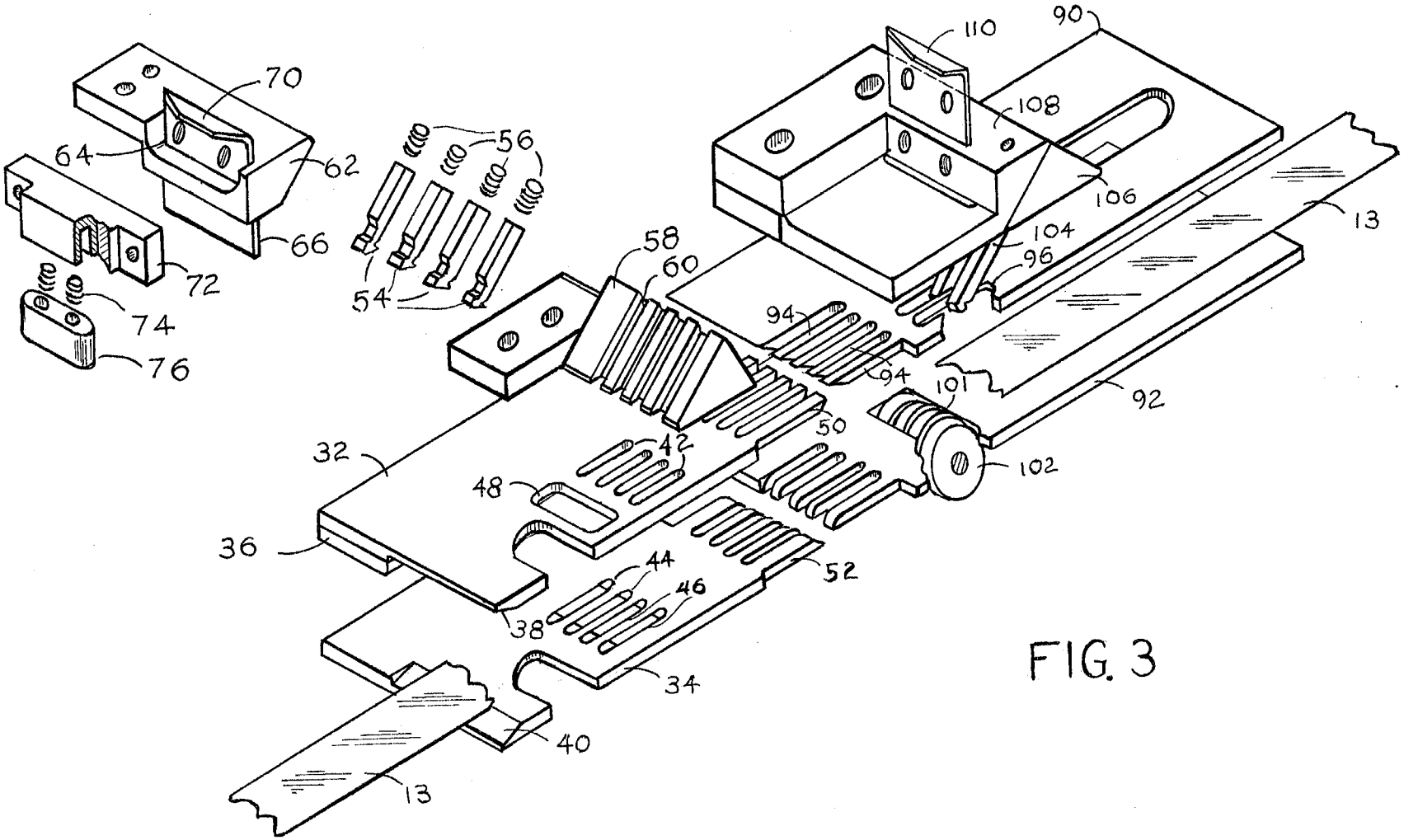
FIG. 3 is an isometric view in exploded form of the interrelated elements of the strip feeder.

Turning now in detail to the apparatus shown in FIGS. 1, 2 and 3 herein illustrated is the Incremental Strip Feeder 10 with base 11 which mounts on the frame of a converting press 12 by means of bolts 14. The base 11 is bored to receive, in sliding engagement, a pair of parallel slide rods 15 which connect a reciprocating slide head 16 to a clevis block 20. A connecting bar 24 is connected to the clevis block 20 by means of a pivot pin 22. A bell crank 30 is pivotally connected to connecting bar 24 by means of a pivot 26. The bell crank 30 is mounted on shaft 28 where it is rocked by a cam (not shown). Pivot 26 engages a slot (not shown) in the arm of crank 30 so that the throw of the crank may be altered according to well known practice to permit minor adjustment of the length of the stroke.

Joined to slide head 16 are upper and lower guide plates 32 and 34 separated by a spacer 36. Horizontal guide rolls 37 are employed to keep soft aluminum strip 13 in alignment and against spacer 36, which serves as a guide fence. The leading edges 38, 40 of the guide plates are rounded to function as a lead-in surface for strip fed to the instant apparatus. The trailing edges of the upper and lower guide plates are provided with a series of teeth 50 and 52. Upper reciprocating guide plate 32 is provided with a series of four longitudinal slots 42. These slots are disposed over corresponding slots 44 in the lower reciprocating guide plate 34 in which a set of carbide anvils 46 are received. Forward of longitudinal slots 42 in the upper reciprocating guide plate 32 is a transverse slot 48.

A series of four gripper elements 54 disposed above upper reciprocating guide plate 32 are biased by springs 56 to pass thru slots 42 so as to engage strip 13 between the gripper head and the corresponding anvil 46. The four grippers are received within recesses 60 in gripper housing 58 and are inclined at an angle of 30° to the plane of strip 13. A gripper retaining head 62 is fastened to gripper housing 58 and guide elements 32, 34 and 36 by means of a pair of bolts 63. A slot 64 is cut in retainer 62 to receive a gripper stop 66 which limits the extent of downward movement of grippers 54.

Abutting the outer face of retainer 62 is friction pad block 72 which has a cavity to receive friction pad 76 which is downwardly biased by springs 74. Friction pad 76 is received within slot 48 so as to engage strip 13 between the pad and the lower guide plate 34. The pad serves as a brake to overcome inertial effects of the moving strip. This is important particularly where the strip is of relatively heavy gage.

Figure 4:
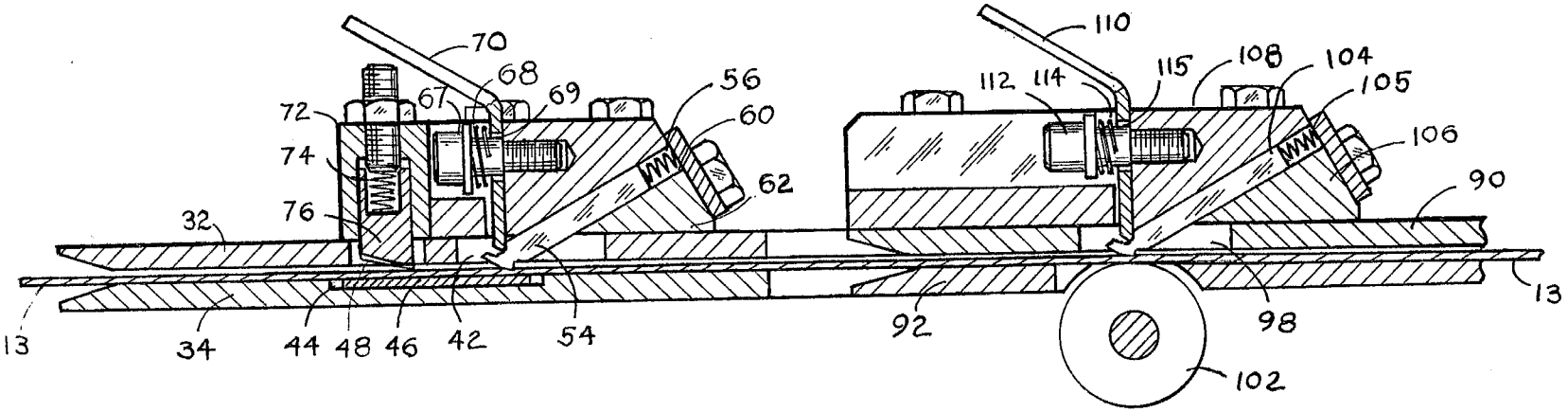
FIG. 4 is a vertical section of the upper portion of FIG. 2 as viewed in the plane labeled 4—4 in FIG. 1 and showing the grippers, anvils and friction pad in engagement with the strip.

Upper and lower stationary guide plates 90 and 92 cooperate with the corresponding reciprocating guide plates 32 and 34 to provide a continuous guiding surface as best shown in FIG. 1. Teeth 94 and 96 of the stationary guides are engaged to a greater or lesser degree by teeth 50, 52 of the reciprocating guides. Upper stationary guide plate 90 is provided with a series of four longitudinal slots 98 which are designed to admit stationary grippers 104. Lower stationary guide plate 92 is slotted to receive a segment of four free wheeling rotary anvils which are mounted on a common spindle. The four rotary anvils cooperate with the four grippers to engage the strip therebetween. The stationary grippers 104 correspond with reciprocating grippers 54 in configuration and inclination to the plane of strip 13, herein after referred to as the strip plane. The stationary grippers are however, biased with a lighter spring loading than the reciprocating grippers. The grippers are mounted in gripper housing 106 which receives the gripper elements and inclines them at an angle of 30° to the strip plane. The stationary grippers are retained by a retaining block 108. A stop 110 is provided to engage a slot in the gripper head and thereby constrain its downward movement. A pair of mounting bolts 112 which are provided with biasing springs 114 hold the stop 110 in abutment with retaining block 108. In FIG. 4 grippers 54 an 104 are shown in cooperation with their respective anvils 46 and 102 and friction pad 76 to exert control over strip 13.

Figure 5:
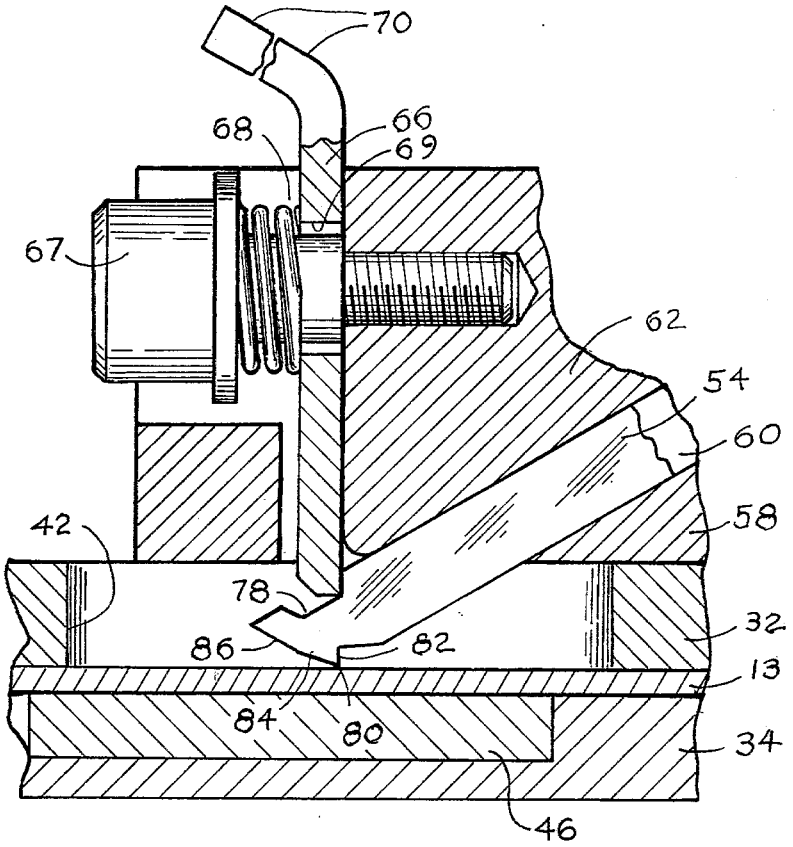
FIG. 5 is an enlarged fragmentary view of the reciprocating gripper housing of FIG. 4 showing in detail the gripper head and its engagement with the gripper stop.

Turning now to FIG. 5, herein shown are grippers 54 mounted in the gripper housing 58 which receives the gripper elements and disposes them at an angle of 30° to the strip plane. The grippers are retained in housing 58 by retainer block 62. Gripper stop 66 is held in abutment with the face of the retainer block by means of biasing springs 68 which act against the head of bolts 67. The tip of gripper stop 66 engages slot 78 of gripper element 54 to constrain the downward movement of the grippers. Depressing stop handle 70 compresses spring 68 causing gripper element 54 to move up the ramp of the gripper housing, thereby releasing strip 13 for manual removal. Gripper element 54 has a contact edge 80 which is sharp. Surface 82 of the gripper is inclined at a rake angle of 5° from the perpendicular to the strip plane. Surface 84 is inclined at an angle of 20° to the strip plane and surface 86 is inclined at an angle of 30° to a strip plane. While FIG. 5 specifically relates to gripper 54, the configuration is equally applicable to gripper 104.

In operation, strip 13 is manually threaded into the feeder between guide plates 32 and 34 passing under friction pad 76, and then between grippers 54 and anvils 46. In passing under grippers 54 the strip 13 first contacts surface 84 which serves as a lead-in to assist the strip in passing under edge 80. If the edge of strip 13 is curled upward, it may strike surface 86 rather than 84 in which case the sharp angle of surfaces 86 will redirect the strip. The threading process is continued until the strip is engaged by grippers 104 as well as 54. Where necessary, the threading process may be facilitated by depressing handles 70 and 110, thereby lifting gripper elements 54 and 104.

When the strip 13 has been threaded into the incremental strip feeder so that both sets of gripper elements have engaged the strip, the reciprocating means can then be activated. The length of stroke and speed of operation is synchronized with the operation of the press.

The cam (not shown) rocks bell crank 30 about pivot 28, thereby reciprocating connecting bar 24 to which it is pivotally connected and in turn, the reciprocating head 16 which is joined to connecting bar 24 by the parallel slide bars 15 and clevis block 20.

On the forward reciprocating stroke, contact edges 80 of grippers 54 cooperate with anvils 46 to seize and advance strip 13. The advancing strip moves readily under stationary gripper 104 due to the lead-in surface and the rotary anvil. At the termination of the forward stroke, grippers 54 release strip 13 and start to return by sliding over the surface. The advancing strip has a tendency to coast. This inertial tendency is accentuated if the strip is heavy. Friction pad 76 is employed as a brake to prevent this forward coasting. Any tendency for the strip to retire along with the retreating grippers 54 is overcome by stationary grippers 104 when the sharp edge produced by the 5° rake angle acts like a barb.

While the instant strip feeder has been described in relation to the feeding of soft aluminum strip to a can end conversion press, it should be appreciated that the apparatus may be readily adapted to handle other materials such as plastic, coated metal or paper. Materials other than soft aluminum may require some departure from the angle of inclination defined herein to prevent marring and still ensure effective feeding. For equal spring loading soft materials require a greater angle of inclination than hard materials do.

Further, it should be recognized, that while the preferred embodiment employs the reciprocating grippers before the stationary grippers in other applications, it may be advisable to reverse the order and install the stationary grippers before the reciprocating grippers. In such a case the strip is pulled rather than pushed under the stationary grippers. Other modifications and applications for the advancement of materials will be apparent to those skilled in the art.

Thus it can be seen that the instant invention affords a means of incrementally advancing soft strip or foil without defacing the surface thereof.

It may further be seen that the instant invention affords a means of precisely advancing strip by minimizing slippage or lost motion, thereof in each incremented advance.

Finally, it may be seen that the instant apparatus is compact, economical to manufacture and readily serviced.

What is claimed is:

1. An apparatus for incrementally advancing strip material comprising:

(a) a base;

(b) a first feeding surface mounted on said base, with an input end and a discharge end;

(c) a second feeding surface mounted in alignment with and coplanar to said first feeding surface with an input end and a discharge end;

(d) a first gripping means disposed over said first feeding surface comprising:

(i) a plurality of gripper elements;

(ii) a gripper housing slotted to receive said gripper elements in parallel array and in transverse disposition to the longitudinal axis of said first feed surface;

(iii) a gripper biasing means mounted on said gripper housing to exert a force on said gripper elements whereby said gripper elements are urged to slide in said slots and thereby bear against said strip metal;

(e) a second gripping means disposed over said second feeding surface comprising:

(i) a plurality of gripper elements;

(ii) a gripper housing slotted to receive said gripper elements in parallel array and in transverse disposition to the longitudinal axis of said second feed surface;

(iii) a gripper biasing means mounted on said gripper housing to exert a force on said gripper elements whereby said gripper elements are urged to slide in said slots and thereby bear against said strip metal; and (f) means for reciprocating, in unison, said second feeding surface and said second gripping means toward and away from said first gripping means whereby said second gripping surface and second gripping means cooperate to seize and advance said strip metal toward said first gripping means and releases said strip metal as they reciprocate away from said first gripping means and whereby said first feeding surface and said first gripping means cooperate to accept said strip metal as it is advanced and to seize and hold said strip metal when said second gripping means reciprocates away from said first gripping means.

2. Apparatus as recited in claim 1 wherein said apparatus additionally includes a first feeding surface with an input end which is toothed and a second feeding surface with a discharge end which is toothed and wherein said toothed surfaces intermesh to provide a continuous feeding surface during the reciprocation of said second feeding surface and said second gripping means.

3. Apparatus as recited in claim 1 and further comprising stop means and stop biasing means mounted of each of said first and second gripper housings and wherein said stop means is held in abutment with said gripper housing by said stop biasing means and wherein said stop means includes a handle means and a tip with said tip engaging said gripper element to limit the sliding movement thereof and wherein said biasing means may be released and said gripper elements raised by depressing said handle means.

* * * * *